United States Patent [19]

Yoshida

[11] 3,999,368

[45] Dec. 28, 1976

[54] CIRCUIT FOR AN ELECTRONIC TIMEPIECE

[75] Inventor: Makoto Yoshida, Tokorozawa, Japan

[73] Assignee: Citizen Watch Co., Ltd., Tokyo, Japan

[22] Filed: Dec. 9, 1975

[21] Appl. No.: 639,169

[30] Foreign Application Priority Data

Dec. 11, 1974 Japan ..... 49-141483
Dec. 20, 1974 Japan ..... 49-145716[U]
Dec. 26, 1974 Japan ..... 50-002327

[52] U.S. Cl. ..... 58/23 BA
[51] Int. Cl.[2] ..... G04C 3/00
[58] Field of Search ..... 58/23 R, 23 A, 23 BA, 58/50 R; 321/15, 16

[56] References Cited

UNITED STATES PATENTS 3,668,860 6/1972 Diersbock ..... 58/23 BA
3,750,383 8/1973 Kakizawa ..... 58/23 BA
3,818,484 6/1974 Nakamura et al. ..... 58/23 R
3,886,724 6/1975 Kamiya ..... 58/23 BA

*Primary Examiner*—L. T. Hix
*Assistant Examiner*—Vit W. Miska
*Attorney, Agent, or Firm*—Spensley, Horn and Lubitz

[57] ABSTRACT

A circuit in an electronic timepiece including a battery, a crystal oscillator, a frequency divider, a display driver and a display for reducing the magnitude of the voltage to one or more of the oscillator or driver circuits after the timepiece is turned on. The circuit initially allows the magnitude of the voltage applied to be the same as that of the battery. After some predetermined time has elapsed, the circuit reduces the applied voltage thereby reducing the power consumption and extending battery life.

8 Claims, 4 Drawing Figures

CIRCUIT FOR AN ELECTRONIC TIMEPIECE

FIELD OF INVENTION

The present invention relates to electronic timepieces and more particularly to circuits for electronic timepieces.

DESCRIPTION OF THE PRIOR ART

With the development of the electronic timepiece, particularly in the area of wristwatches, the efficiency as well as the power consumption of the circuits used in an electronic timepiece have come under scrutiny. Since the power available to the electronic timepiece is limited, the investigation into the circuits used in electronic timepieces has been directed at reducing the power consumption and increasing the efficiency. The power consumption of the electronic circuits used in the electronic timepiece has been drastically reduced by using CMOS technology. Utilizing CMOS technology and operating the individual CMOS circuits at their minimum operating voltage has reduced power consumption and extended battery life. However, even such techniques have a minimum limit which is higher than the minimum operating power required by the electronic timepiece.

SUMMARY OF THE INVENTION

In keeping with the principles of the present invention, the objects are accomplished by a circuit in an electronic timepiece including a crystal oscillator circuit, a battery, a frequency divider circuit, a display driver circuit and a display for reducing the magnitude of the voltage applied to one or more of the oscillator divider or driver circuits after the insertion of a new battery and a timepiece is initially turned on. Since some of the circuits in the electronic timepiece initially require a higher voltage to start than they require for continued operation, the circuit initially allows the magnitude of the voltage applied to those circuits to be the same as that of the battery. After some predetermined time has elapsed and all of the circuits of the electronic timepiece have stabilized, the circuit reduces the applied voltage to that level required for continuous operation thereby reducing the power consumption and extending battery life.

It is a general object of the present invention to provide an electronic timepiece having low power consumption.

It is another object of the present invention to provide an electronic timepiece which requires fewer battery replacements during the lifetime of the timepiece.

It is still another object of the present invention to provide a electronic timepiece which is highly reliable.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which.

DESCRIPTION OF THE PREFERRED EMBODIMENTS

Figure 1:
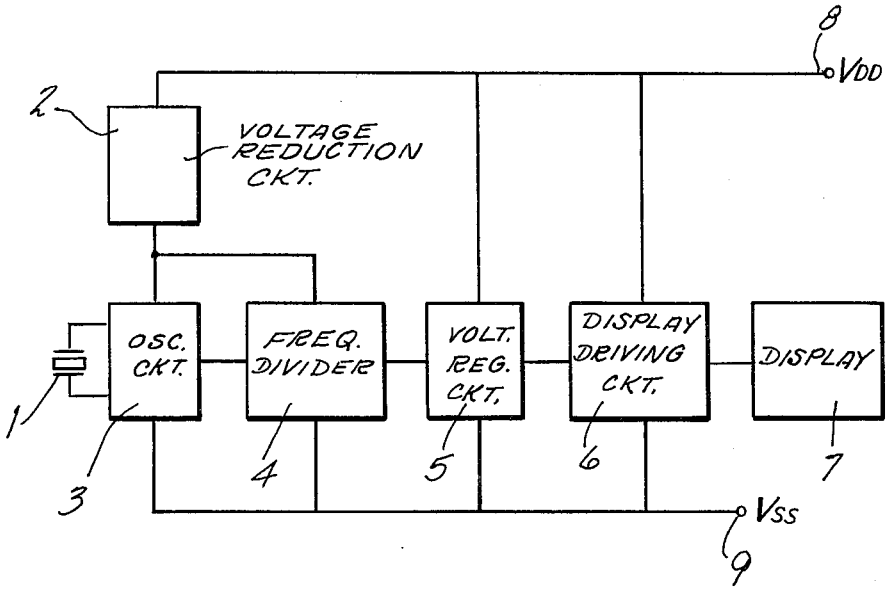
FIG. 1 is a block diagram of an electronic timepiece in accordance with the teachings of the present invention.

FIG. 1 is a block diagram of an electronic timepiece circuit system according to the principles of the present invention. Blocks 1 and 2 represent respectively a quartz crystal oscillator and a voltage producing element. Blocks 3, 4, 6 and 7 are respectively the oscillator circuit, the frequency divider circuit, display driving circuit, and the display, respectively. Since the details of these circuits are well-known in the art and are similar to those disclosed in application for U.S. Letters Patent Ser. No. 534,063, a detailed description of the individual circuits is omitted for brevity in this application. Block 5 is a voltage regulating circuit which comprises a plurality of inverters, one inverter in each signal path from frequency divider 4 to display driving circuit 6. Terminal 8 represents a source of DC voltage of magnitude $V_{DD}$ and terminal 9 represents the voltage return of magnitude $V_{SS}$. Since the time setting means is not essential to the present invention, it is not shown in block diagram FIG. 1.

The output from oscillator circuit 3 is coupled to frequency divider circuit 4. The output signal from frequency divider circuit 4 is coupled to voltage regulator circuit 5. The output of voltage regulator 5 is coupled to the input of display driving circuit 6. The output of display driving circuit 6 is coupled to display means 7. Furthermore, while the voltage regulator circuit 5 and the driving circuit 6 are coupled directly to the source of power, the oscillator circuit 3 and the frequency divider circuit 4 are coupled to the source of voltage by means of voltage reduction circuit 2.

In operation if a source of DC voltage of magnitude 1.5 volts is applied to terminals 8 and 9 a initial voltage of approximately 1.5 volts is applied to all of the circuits. Initially, voltage reduction circuit 2 allows quartz oscillator 1 together with oscillation circuit 3 to oscillate by supplying approximately the same voltage level as furnished by the source of DC voltage to oscillator circuit 3. Stabilization and power conservation can be achieved by adding a timer function to that of voltage reduction circuit 2 such that the magnitude of the source of DC voltage is reduced after a predetermined period of time has elapsed. Since the voltage reduction circuit 2 supplies the voltage to both the frequency divider circuit 4 and the oscillator circuit 3, the power consumption of the frequency divider circuit 4 is likewise reduced. Since frequency divider circuit 4 is operated at the same supply voltage as that of oscillator 3, it does not malfunction since the logic level of oscillator circuit 3 can adequately trigger frequency divider circuit 4. Voltage regulating circuit 5 boost the amplitude of the signals from frequency divider circuit 4. The output signals from voltage adjustment circuit 5 are applied to the display drive circuit 6 which drives display 7. Display 7 can be a stepping motor, a liquid crystal optical display, light-emitting diode optical display or any other means utilized to indicate the time. Furthermore, display drive circuit 6 must be compatable with display 7.

In addition to the stabilization and reduction in electrical power consumption, another advantage of the present invention is achieved by adjusting the voltage reducing circuit 2 such that minimum operating voltage of display 7 and the minimum operating voltage of the electronic circuits are approximately equal. Thusly, the energy contained in the battery will be fully utilized thereby eliminating waste and resulting in an electronic timepiece with a long life. It has been confirmed experimentally that with a source of DC voltage of 1.5 volts, a voltage drop by the voltage reducing circuit 2 of 0.35 volts, a liquid crystal display is utilized, and CMOS integrated circuits, the circuits operate at 0.5 microamps and the liquid crystal display at 0.5 microamps. Thusly, the total required current is 1 microamp. As explained above, a long life, highly stable electronic timepiece can be realized by means of the present invention.

Figure 2:
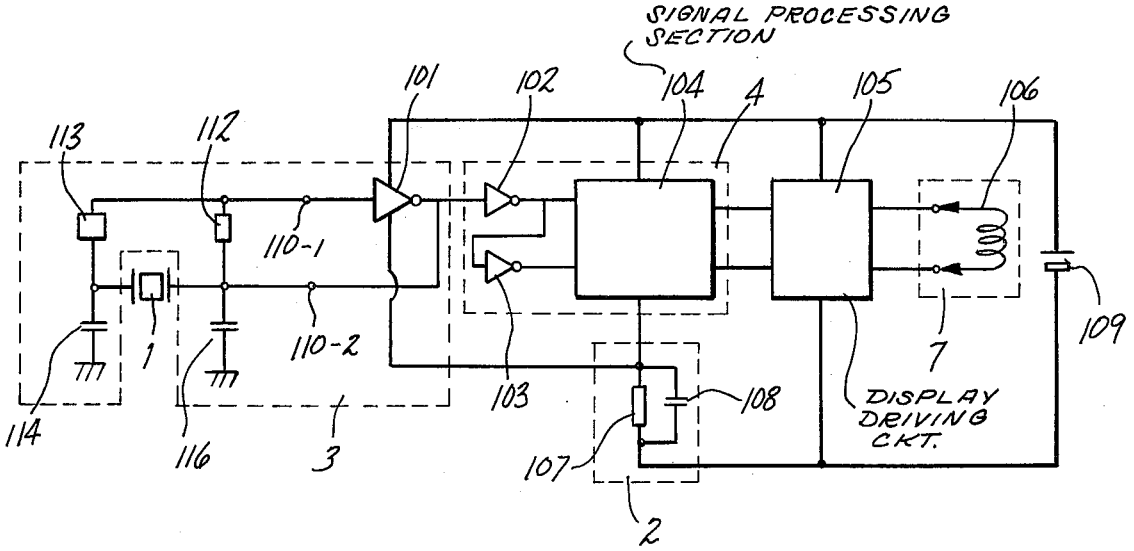
FIG. 2 is one embodiment of the electronic timepiece of FIG. 1.

Referring to FIG. 2, shown therein is a circuit diagram of a first embodiment of an electronic timepiece in accordance with principles of the present invention. The electronic timepiece circuit of FIG. 2 includes a CMOS inverter 101. The output of inverter 101 is coupled to the input of inverter 102 and the output of inverter 102 is coupled to the input of signal processing section 104 and the input of inverter 103. The output of inverter 103 is also coupled to the input of signal processer 104. Signal processing section 104 includes a frequency divider, wave form generator, control section and other circuits all of which are well-known in the art. Display driver circuit 105 produces the driving signal for transducer coil 106. All the input signals to display driver circuit 105 are passed through inverters for voltage adjustment and the inverters are included in display driver circuit 105. The parallel connection of resistor 107 and capacitor 108 form a time constant circuit. The two ends of the parallel combination of resistor 107 and capacitor 108 are coupled respectively to the return side of battery 109 and the voltage return terminal of inverter 101 and signal processing section 104. The two ends of oscillator 1 are coupled respectively to the terminal formed by the connection of capacitor 116 and resistor 112 and the terminal formed by the connection of resistor 113 and capacitor 114. The other ends of capacitor 114 and capacitor 116 are coupled to ground and the other ends of resistor 112 and resistor 113 are coupled together and coupled to the input of inverter 101. The output inverter 101 is also coupled to the terminal formed by the connection of resistor 112 and capacitor 116.

Those portions of the circuit indicated by blocks are well-known in the art and consequently a brief expanation will be made.

In operation, oscillator circuit 3 starts to oscillate when activated by the total voltage from battery 109. Inverter 102 receives the output from oscillator circuit 3 and converts the wave form into a series of pulses with a steeply rising edge. Inverter 103 receives the signal from inverter 102 and likewise adjusts the wave form and inverts the phase, thereby generating an input to signal processing circuit 104 in which the frequency divider is included. Signal processing section 104 receives the output signals from inverter 102 and 103 and produces an input to driver section 105 by setting the phase and timing of the current that flows into a series of frequency dividers, reset circuits, and coil 106 of the stepping motor. Driving circuit 105 comprises two pairs of inverters with low output impedence and forces a current into coil 106 at a rate of, for example, one pulse per second, and reverses the direction of the current after 1 second to cause the movement of the pointer needle.

The values of resistor 107 and capacitor 108 of FIG. 2 are set in the following manner. For example, the case in which the voltage of the battery 109 is 1.55 volts and the operating voltage of the circuit is set at 1.30 volts. Further letting the current I expressed in microamps be the current through the inverter 101 and the operating voltage 1.3 volts divided by 2 equals 0.65 volts is applied to terminal 110-1 the value of resistor 107 is calculated as follows:

$$R = \frac{1.55 - 1.30}{I} \; Meg\Omega$$

The value for capacitor 108 is now calculated by taking the time constant of RC as equal to 10 times the period of oscillation of the crystal oscillator or in other words:

$$RC = 10/F$$

The calculation of the value of capacitor 108 is readily obtainable from the foregoing equation by substituting the frequency of the quartz crystal oscillator and the value of the resistant previously calculated.

As a result, the power consumption is reduced to 70% of that if the full 1.55 volts were appled to the oscillator and frequency dividers. Furthermore, due to an increased equivalent resistant for leakage and other reasons, it is possible to considerably reduce the power consumption of the circuit. Since the total source voltage of 1.55 volts is applied to the driver circuit 105 there is no effect on the magnitude of the driving signal when using the present invention and it is thus possible to improve the overall efficiency without any adverse side effects.

The proceeding description indicates the effectiveness of the present invention in prolonging the life of the battery and makes it possible to use smaller batteries because of a saving in power consumption without deterioration of the output characteristics of the circuit.

Figure 3:
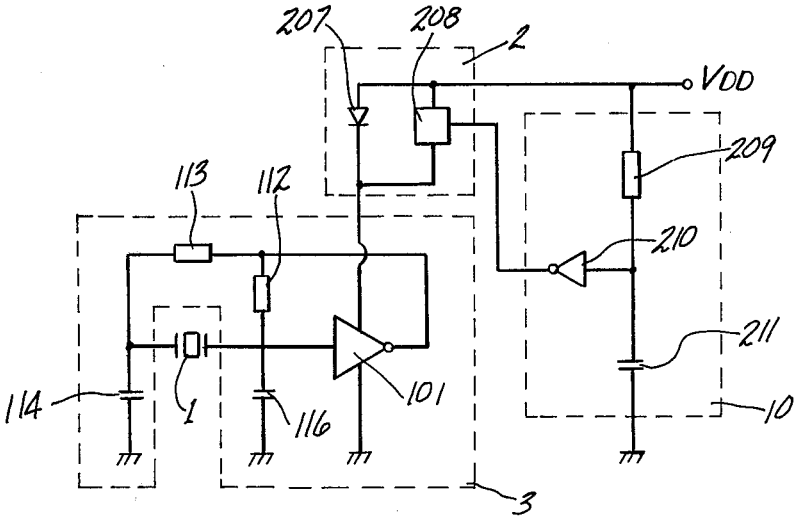
FIG. 3 is a circuit diagram of a portion of the electronic timepiece of FIG. 1 showing a second embodiment of the present invention.

FIG. 3 is a second embodiment of the present invention which is characterized by a voltage reduction circuit 2 cooperating with a control circuit 10. For the sake of brevity, FIG. 3 shows only the quartz crystal 1, oscillator circuit 3, voltage reduction circuit 2 and control circuit 10. The remainder of the circuit such as the frequency divider circuit 4, display driving circuit 5, et cetera, remain the same as in FIG. 2. The crystal oscillator circuit 3 is a Colpitts oscillator which is the same as that in FIG. 2 and can be interconnected to the frequency divider circuit 4 in substantially the same way as shown in FIG. 2.

In the embodiment of FIG. 3, the major consumption of electric power in the oscillator circuit 3 stems from the current drain and charge-discharge current of the output capacitor 114 that are apparently in inverter 101 changes state. Since said currents are proportional to the source voltage, it is desirable to operate the oscillator circuit at the lowest possible voltage. However, in order to set the source voltage at a low value, difficulties are encountered such as an exceedingly long startup time for oscillations and even a startup failure when the inverter gain 101 is too. These difficulties are overcome by the circuit shown in FIG. 3. The voltage reduction circuit 2 of FIG. 3 comprises a diode 207 whose cathode and anode are coupled respectively to the output and input of transmission gate 208. The input of transmission gate 208 is connected to a source of DC voltage represented by $V_{DD}$. The output of transmission gate 208 is coupled to the input power port of inverter 101 and a common terminal of inverter 101 is grounded. Control circuit 10 comprises the series connection of capacitor 211 and resistor 209. The control port of transmission gate 208 is coupled to the terminal comprising one end of capacitor 211 and one end of resistor 209 via inverter 210. The other ends of capacitor 211 and resistor 209 are coupled respectively to ground and a source of DC power represented by $V_{DD}$. Furthermore, the output of transmission gate 208 may be connected to the input power terminal of frequency divider 4.

In operation, a time constant circuit is constructed using the resistor 209 and capacitor 211. Inverter 210 acts as a comparator circuit. As a result, transmission gate 208 is controlled on and off by the output signal of inverter 210. When the source voltage $V_{DD}$ is applied to the surface, the input voltage to inverter 210 will rise as a function of the time constant of the time constant circuit resistor 209 and capacitor 211 as capacitor 211 charges through resistor 209. When the voltage across capacitor 211 reaches the operating voltage of inverter 210, the output signal of inverter 210 will change its state from a logical 1 to a logical 0. If transmission gate 208 is set at on when the output of inverter circuit 210 is a logical 1 and off when the output of inverter circuit 210 is a logical 0, the transmission gate 208 is on for the initial time span which is determined by the time constant of resistor 209 and capacitor 211 and off thereafter. As a consequence, the voltage applied to inverter 101 during startup is $V_{DD}$ for a time span depending on the time constant of resistor 209 and capacitor 211 and then drop to $V_{DD}$ minus $V_F$, where $V_F$ the voltage drop across diode 207. If one chooses the value for the time constant such that the length of the initial time span is approximately 3 seconds, the interval is sufficient for startup of an ordinary oscillator circuit.

It has been determined experimentally that when the source voltage is 1.55 volts the voltage drop in the normal direction of diode 207 is 0.35 volts, and one volt is the threshold voltage of the CMOS circuits, the inverter 101 is supplied with a voltage of 1.55 volts for 3 seconds upon insertion of the battery and then set at 1.20 volts. Favorable operation was confirmed and the current drawn by the oscillator circuit in the embodiment of FIG. 3 was 1.2 microamps, which was less than half that previously required. Furthermore, in other experiments, a current reduction to 0.7 microamps was confirmed in the case of the embodiment of FIG. 3 as compared to 1.5 microamps for a system without the voltage reduction circuit. The startup of oscillation was smooth in both cases.

Figure 4:
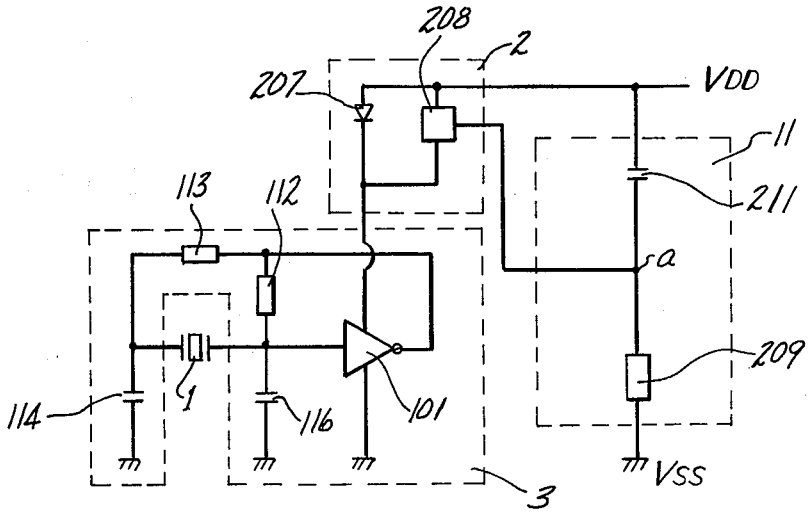
FIG. 4 is a circuit diagram of a portion of the electronic timepiece of FIG. 1 showing a third embodiment of the present invention.

FIG. 4 is a third embodiment of the present invention and is a simplification of that shown in FIG. 3. The embodiment shown in FIG. 4 is substantially the same as that in FIG. 3 except that inverter 210 is omitted and the placement of resistor 209 and capacitor 211 is reversed.

In operation, when the battery is initially connected to the circuits, the source voltage $V_{DD}$ is imposed upon the junction point *a* of capacitor 211 and resistor 209. This voltage at junction point A of $V_{DD}$ corresponds to a logical 1 and is coupled to the control port of transmission gate 208 thereby turning on transmission gate 208. The magnitude of the voltage at junction point *a* then decays with time at a rate set by the time constant of resistor 209 and capacitor 211. When the magnitude of the voltage at junction *a* declines to a value which corresponds to a logical 0, transmission gate 208 turns off and the voltage applied to oscillator 3 is reduced to $V_{DD}$ minus $V_F$.

A parallel connection of the transmission gate 208 and diode 207 is shown in all of the preceding embodiments, but it is also possible to replace them by various other types of semiconductor switching elements such as a MOS transistor, et cetera without departing from the spirit and scope of the present invention.

The present invention provides a very effective approach to the reduction of electric power consumption without impairing the starting capability of the oscillator by adding a simple circuit to the oscillator circuit of the quartz crystal as disclosed in the preceding description.

In all cases it is understood that the above described embodiment is merely illustrative of one of the many possible specific embodiments which represent the applications of the principles of the present invention. Furthermore, numerous and varied other arrangements can be readily devised in accordance with the principles of the present invention by those skilled in the art without departing from the spirit and scope of the invention.

I claim:

1. An electronic timepiece of the type comprising a crystal oscillator, an oscillator circuit, a display, a circuit that utilizes said oscillator as a reference and excites said display, and a battery as a common source of voltage for said circuits, the improvement comprising a means for reducing the magnitude of the voltage applied to at least one of said circuits after some initial, predetermined time period has elapsed since the electronic timepiece has been turned on to a predetermined operating voltage.

2. An electronic timepiece according to claim 1 wherein said voltage reducing means comprises:

a resistor; and a capacitor, said capacitor being coupled in parallel with said resistor, said parallel combination of said capacitor and resistor being coupled between the voltage return terminal of at least one of said circuits and the voltage return terminal of said battery.

3. An electronic timepiece according to claim 1 wherein said voltage reducing means comprises:

a diode;

a transmission gate having an input, an output and a control port, said transmission gate being coupled in parallel with said diode, said parallel combination of said transmission gate and said diode being coupled between said battery and at least one of said circuits;

a capacitor; and a resistor, said resistor being connected in a series with said capacitor, said series coupled capacitor and resistor being coupled across the positive and negative terminals of said battery, said connection between said resistor and said capacitor further being coupled to the control port of said transmission gate.

4. The electronic timepiece according to claim 3 further comprising an inverter inserted between said connection between said resistor and capacitor and said control port of said transmission gate.

5. An electronic timepiece of the type comprising a crystal oscillator, a oscillator circuit, a frequency divider circuit, a display driver circuit, a display, a battery as a common source of voltage, and a voltage reduction circuit, said voltage reduction circuit comprising a circuit for reducing the magnitude of the voltage applied to at least said oscillator circuit after some initial, predetermined time period has elapsed since the electronic timepiece has been turned on to a predetermined operating voltage.

6. An electronic timepiece according to claim 5 wherein said voltage reducing means comprises:

a resistor; and a capacitor, said capacitor being coupled in parallel with said resistor, said parallel combination of said capacator and resistor being coupled between the voltage return terminal of at least one of said circuits and the voltage return terminal of said battery.

7. An electronic timepiece according to claim 5 wherein said voltage reducing means comprises:

a diode;

a switching device having an input, an output and a control port, said switching device being coupled in parallel with said diode, said parallel combination of said switching device and said diode being coupled between said battery and at least one of said circuits;

a capacitor; and a resistor, said resistor being connected in a series with said capacitor, said series coupled capacitor and resistor being coupled across the positive and negative terminals of said battery, said connection between said resistor and said capacitor further being coupled to the control port of said switching device.

8. The electronic timepiece according to claim 7 further comprising an inverter inserted between said connection between said resistor and capacitor and said control port of said switching device.

* * * * *